US008106574B2

(12) United States Patent
Yoshida et al.

(10) Patent No.: US 8,106,574 B2
(45) Date of Patent: Jan. 31, 2012

(54) ELECTRIC BULB FOR USE IN A VEHICLE HEADLAMP

(75) Inventors: Tatsumi Yoshida, Tokyo (JP); Toshiyuki Matsuzaki, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 364 days.

(21) Appl. No.: 12/257,180

(22) Filed: Oct. 23, 2008

(65) Prior Publication Data

US 2009/0108751 A1 Apr. 30, 2009

(30) Foreign Application Priority Data

Oct. 31, 2007 (JP) ..... 2007-283496

(51) Int. Cl.
*H01K 9/00* (2006.01)
*H01K 1/50* (2006.01)

(52) U.S. Cl. ..... 313/316; 313/579

(58) Field of Classification Search ..... None
See application file for complete search history.

(56) References Cited

U.S. PATENT DOCUMENTS 4,441,051 A * 4/1984 Thomas ..... 313/579
4,603,278 A * 7/1986 Devir et al. ..... 313/318.07

FOREIGN PATENT DOCUMENTS

JP 2006147385 6/2006

OTHER PUBLICATIONS

Machine Translation of JP2006-147385.*

* cited by examiner

*Primary Examiner* — Toan Ton
*Assistant Examiner* — Britt D Hanley
(74) *Attorney, Agent, or Firm* — Kenealy Vaidya LLP

(57) ABSTRACT

A lamp can include a low-beam filament arranged in a horizontal reference plane containing an optical axis of a glass bulb, and facing in a direction orthogonal to the optical axis. A high-beam filament can be arranged in a plane normal to the horizontal reference plane and in parallel with the low-beam filament. A pair of inner leads for supporting the low-beam filament can be located in the horizontal reference plane. A pair of inner leads for supporting the high-beam filament can be located in a plane defined in parallel with the optical axis and normal to the horizontal reference plane.

15 Claims, 4 Drawing Sheets

ELECTRIC BULB FOR USE IN A VEHICLE HEADLAMP

This application claims the priority benefit under 35 U.S.C. §119 of Japanese Patent Application No. 2007-283496 filed on Oct. 31, 2007, which is hereby incorporated in its entirety by reference.

BACKGROUND

1. Technical Field

The presently disclosed subject matter relates to a mount structure for use in electric lamps, and more particularly to a mount structure for use in electric bulbs of the double-filament type for use in vehicular headlamps.

2. Description of the Related Art

FIG. 5 shows a lamp that includes a conventional mount structure for double filaments supported in a glass bulb. The lamp comprises an almost cylindrical glass bulb 50, which contains a filament serving as a high beam light-emitting source (high-beam filament) 51 and a filament serving as a low beam light-emitting source (low-beam filament) 52. These two filaments are arranged in parallel and almost in the same plane which is normal to the longitudinal direction of the glass bulb 50. The ends of the filaments 51, 52 are connected to and supported on two pairs of inner leads 51*a*, 51*b* and 52*a*, 52*b*.

The inner leads 52*a*, 52*b* for supporting the low-beam filament 52 linearly extend a certain length from a bridge 53 in a direction substantially (exactly or almost) normal to the bridge 53 and have respective ends connected to ends of the low-beam filament 52.

On the other hand, the inner leads 51*a*, 51*b* for supporting the high-beam filament 51 are held at the bridge 53 inward from the pair of inner leads 52*a*, 52*b*. The inner leads 51*a*, 51*b* extend a certain length linearly from the bridge 53 in parallel with the inner leads 52*a*, 52*b*. They are then bent and extend a certain length linearly away from the bridge 53 outward (toward the positions of the inner leads 52*a*, 52*b*). They are bent again and extend a certain length linearly in parallel with the inner leads 52*a*, 52*b*. The ends of the inner leads 51*a*, 51*b* are connected to the ends of the high-beam filament 51.

As shown in FIG. 6, in a mount structure 56 configured as described above, the low-beam filament 52 and the pair of inner leads 52*a*, 52*b* for supporting the filament 52 are all located in a substantially horizontal reference plane H in the bulb 57. The high-beam filament 51 is located in a plane normal to the horizontal reference plane H and in parallel with the low-beam filament 52 and substantially in the same plane (see, for example, Japanese Patent Application No. JP 2006-147385A and its corresponding English translation, which are hereby incorporated in their entirety by reference).

Referring again to FIG. 5, in the above-configured mount structure 56, the light emitted from the low-beam filament 52 includes light L that is directed to a lower position (for example, towards the high-beam filament 51) than the horizontal reference plane H in the electric bulb 57. Part of the light L impinges on folded portions 58 of the inner leads 51*a*, 51*b* which support the high-beam filament 51. This part of the light L is then reflected in various directions from the folded portions 58.

Such reflected light (diffused light L) from the folded portions 58 transmits out of regular optical pathways to a reflector 60 having an inner reflecting surface and an outer lens 61 having appropriate lens-cuts for optical path control, as shown in FIG. 7. The reflector 60 and outer lend 61 are arranged to form a low-beam distribution pattern from the light emitted from the low-beam filament 52. Therefore, the reflected light from the high beam filament 51 is non-contributive to the formation of the low-beam distribution pattern, and may exert ill effects on the formation of the low-beam distribution pattern.

As shown in FIG. 8, there are a pair of outer leads 65*a*, 65*b* and a pair of outer leads 64*a*, 64*b*. They are connected to the pair of inner leads 52*a*, 52*b* for supporting the low-beam filament 52 and the pair of inner leads 51*a*, 51*b* for supporting the high-beam filament 51 in the electric bulb 57, respectively, and extend out of the glass bulb 50. These outer leads are connected to a common earth terminal (j), a low-beam filament terminal (i), and a high-beam filament terminal (h) arranged on a bulb base 62 in turn from one side. In this case, the outer lead 64*a* is electrically connected to the high-beam filament and is required to intersect the outer lead 65*a* which is electrically connected to the low-beam filament. In this case, it is possible for both to electrically contact each other at intersection (c) resulting in a short circuit.

The presently disclosed subject matter has been made in consideration of the above characteristics, features and problems and can be configured to provide a technology for a double-filament type lamp in which inner leads for supporting a high-beam filament are prevented from reflecting light emitted from a low-beam filament. This makes it possible to prevent unwanted occurrences of diffused light which do not contribute to formation of the low-beam distribution pattern but rather exerts ill effects. This is effective to form an optimal light distribution pattern.

The disclosed subject matter also includes a lamp that can be configured to prevent outer leads from intersecting and thus avoiding a possible electrical short-circuit when plural terminals are provided in a certain array on a tube base and are connected to the leads.

SUMMARY

According to a first aspect of the disclosed subject matter a mount structure for a lamp can include: a low-beam filament and a high-beam filament contained in a substantially cylindrical glass bulb of an electric bulb; a pair of first leads having respective one side ends to which both ends of the low-beam filament are connected and supported thereon; a pair of second leads having respective one side ends to which both ends of the high-beam filament are connected and supported thereon; and a lead holder between which the other ends of the four leads are held in line, wherein the low-beam filament locates in a first plane containing an optical axis located on the almost same line as the central axis of the glass bulb, facing in a direction orthogonal to the optical axis, wherein the high-beam filament locates in a second plane normal to the first plane and almost in parallel with the low-beam filament, wherein the pair of first leads locate between the lead holder at positions sandwiched between the pair of second leads and locate almost in the first plane between the low-beam filament and the lead holder, wherein the pair of second leads locate in a third plane defined in parallel with the optical axis and substantially normal to the first plane between the high-beam filament and the lead holder.

According to a second aspect of the disclosed subject matter, the pair of first leads include at least two folded parts formed between the low-beam filament and the lead holder, wherein the pair of second leads include at least two folded parts formed between the high-beam filament and the lead holder.

According to a third aspect of the disclosed subject matter, the pair of first leads and the pair of second leads include a pair of leads located adjacent to each other at the lead holder and connected together to configure a common earth lead, the mount structure further comprising a bulb base having a common earth terminal, a low-beam filament terminal, and a high-beam filament terminal, wherein the common earth terminal is connected to the common earth lead, the low-beam filament terminal is connected to one of the pair of first leads, and the high-beam filament terminal is connected to one of the pair of second leads.

According to a fourth aspect of the disclosed subject matter, the glass bulb encloses a halogen gas or a halogen compound gas.

In an exemplary mount structure for an electric bulb according to the disclosed subject matter, the low-beam filament can be arranged in the horizontal reference plane containing the optical axis X of the glass bulb, facing in a direction orthogonal to the optical axis X. The high-beam filament is arranged in a plane normal to the horizontal reference plane and in parallel with the low-beam filament. The pair of inner leads for supporting the low-beam filament is located in the horizontal reference plane. The pair of inner leads for supporting the high-beam filament is located in a plane defined in parallel with the optical axis X and normal to the horizontal reference plane.

As a result, it is possible to prevent the inner leads which support the high-beam filament from reflecting light emitted from the low-beam filament. This makes it possible to prevent the creation of unwanted diffused light, which does not contribute to formation of the low-beam distribution pattern and rather can exerts ill effects on lamp output characteristics. This is effective to form an optimal light distribution pattern.

In addition, the arrangement of the pair of leads for supporting the low-beam filament and the pair of leads for supporting the high-beam filament is aligned with the arrangement of the terminals on the bulb base.

As a result, it is possible to prevent the outer leads from intersecting, thus avoiding a possible electrical short-circuit.

DETAILED DESCRIPTION OF EXEMPLARY EMBODIMENTS

Figure 1:
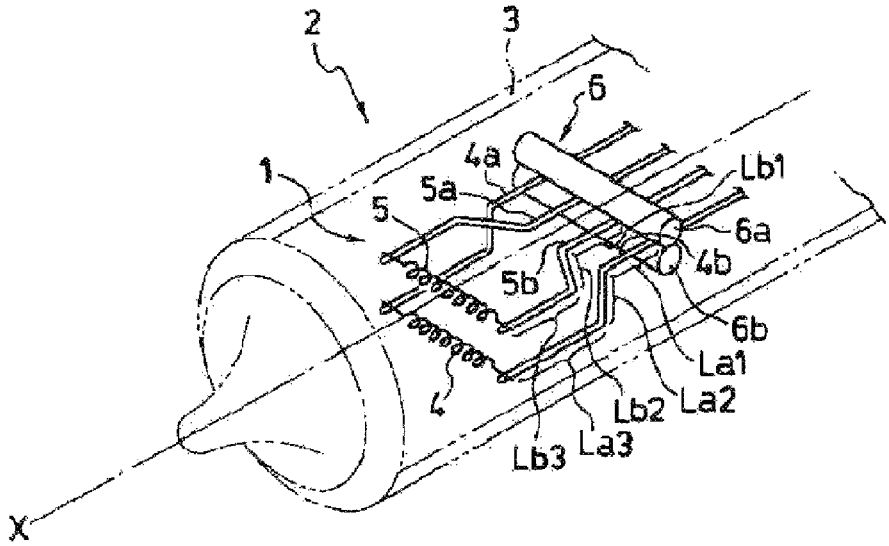
FIG. 1 is a perspective view of an embodiment a lamp made in accordance with principles of the presently disclosed subject matter.
Figure 2:
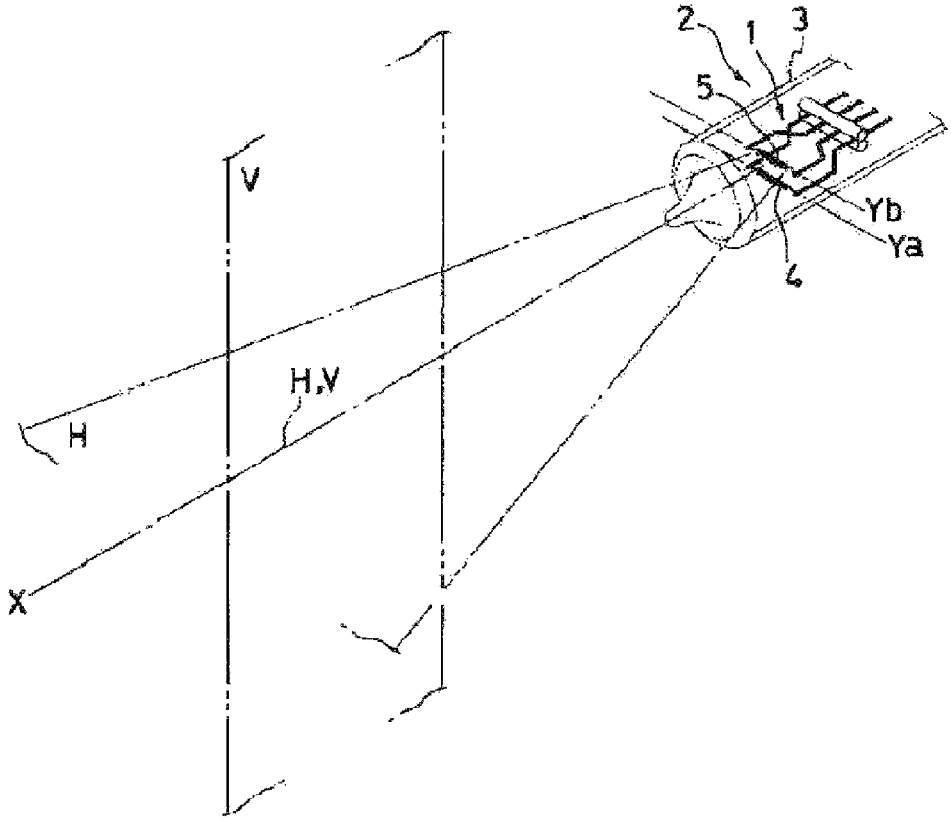
FIG. 2 is an illustrative view of the lamp of FIG. 1.

Certain exemplary embodiments of the disclosed subject matter will now be described in detail with reference to FIGS. 1-4 (with like reference numerals denoting the same or similar parts). The below-described embodiments are suitable specific examples of the presently disclosed subject matter and include various technical features. However, the scope of the presently disclosed subject matter is not limited to these disclosed embodiments.

FIG. 1 is a perspective view of an example of a mount structure made in accordance with principles of the presently disclosed subject matter. The mount structure 1 can include a high-beam filament 4 serving as a high-beam emitting source and a low-beam filament 5 serving as a low-beam emitting source, which can both be contained in a substantially cylindrical bulb 3 of an electric bulb 2. The mount structure 1 can also include a pair of inner leads 4*a*, 4*b* for supporting the high-beam filament 4, a pair of inner leads 5*a*, 5*b* for supporting the low-beam filament 5, and a bridge 6 composed of glass for holding the inner leads 4*a*, 4*b*, 5*a*, 5*b* together. A halogen gas or a halogen compound gas can be located and contained within the bulb 3, which can be made from glass-like material, such as glass, quartz, etc.

The low-beam filament 5 has a longitudinal/central axis Yb, which can be located in a substantially horizontal reference plane H in the electric bulb 2. The bulb 2 can have an optical axis X located on the same or possibly parallel line as the central axis of the glass bulb 3. The longitudinal/central axis Yb extends in a direction substantially orthogonal to the optical axis X. The high-beam filament 4 has a longitudinal/central axis Ya, which can be located in a plane normal to the horizontal reference plane H, substantially in the same plane shape as the central axis Yb of the low-beam filament 5, and in parallel with the central axis Yb (see FIG. 2).

The high-beam filament 4 has ends which are each connected to and supported on respective side ends of the inner leads 4*a*, 4*b*. The low-beam filament 5 has ends which are each connected to and supported on respective side ends of the inner leads 5*a*, 5*b*.

The bridge 6 can be configured as a lead holder and can include a pair of glass columns 6*a*, 6*b* composed of glass, which can be configured as substantially columnar shapes provided in parallel. The longitudinal direction thereof can be substantially parallel with the longitudinal/central axis of the high-beam filament 4 and the longitudinal/central axis of the low-beam filament 5. The inner leads 4*a*, 4*b*, 5*a*, 5*b* have middle portions, which are sandwiched between the pair of glass columns 6*a*, 6*b* and held in line.

The pair of inner leads 5*a*, 5*b* for supporting the low-beam filament 5 are sandwiched and held at the bridge 6 inward from the pair of inner leads 4*a*, 4*b* which support the high-beam filament 4. The whole lines of the inner leads 5*a*, 5*b* extending from the bridge 6 to the ends of the low-beam filament 5 can be substantially located in the horizontal reference plane H.

At the same time, the inner leads 5*a*, 5*b* extend a certain length Lb1 linearly from the bridge 6 in a direction parallel with the optical axis X. The leads 5*a*, 5*b* are then bent and extend a certain length Lb2 linearly away from the bridge 6 and outward (toward the positions of the inner leads 4*a*, 4*b*). They are bent again and extend a certain length Lb3 linearly in a direction parallel with the optical axis X. The ends of these inner leads 5*a*, 5*b* are then connected to the ends of the low-beam filament 5.

On the other hand, the pair of inner leads 4*a*, 4*b* which support the high-beam filament 4 extend a certain length La1 linearly from the bridge 6 in a direction parallel with the optical axis X. The leads 4*a*, 4*b* are then bent and extend a certain length La2 linearly in the direction normal to the longitudinal direction of the bridge 6 downward (toward the position of the high-beam filament 4). They are bent again and extend a certain length La3 linearly in the direction parallel with the optical axis X. The ends of the inner leads 4*a*, 4*b* are then connected to the ends of the high-beam filament 4.

The length La1 of the inner leads 4*a*, 4*b* is not always required to be equal to the length Lb1 of the inner leads 5*a*, 5*b*. The difference between the length La1 the length Lb1 does not necessarily exert influence on the optical characteristic (e.g., the light distribution characteristic) of the electric bulb 2.

FIG. 1 shows lengths of linear portions of the inner lead 4*b* and the inner lead 5*b*. The inner lead 4*a* and the inner lead 5*a* are formed in the same shape as the inner lead 4*b* and the inner lead 5*b*, respectively, and accordingly a detailed description thereof is not provided.

Figure 3:
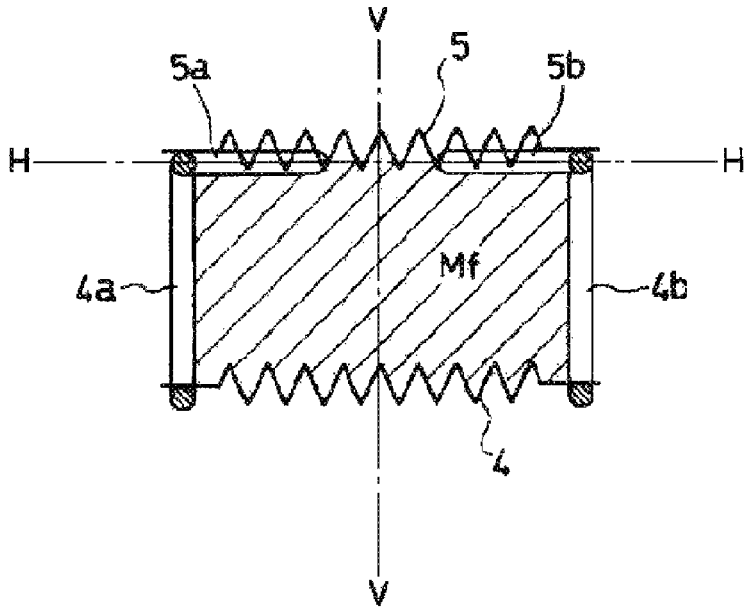
FIG. 3 is a schematic view showing an arrangement of inner leads of the lamp of FIG. 1.

FIG. 3 provides a diagram showing the above-configured mount structure 1 seen from the filaments 4, 5. FIG. 3 shows a positional relation among the high-beam filament 4, the low-beam filament 5, the inner leads 4*a*, 4*b* which support the high-beam filament 4, and the inner leads 5*a*, 5*b* which support the low-beam filament 5.

As can be seen from FIG. 3, an area (containing the depth) sandwiched between the high-beam filament 4 and the low-beam filament 5 forms a metal-free zone Mf, which does not contain any one of the inner leads 4*a*, 4*b*, 5*a*, 5*b*.

Therefore, light emitted from the low-beam filament 5 toward the metal-free zone Mf is not blocked by any one of the inner leads 4*a*, 4*b*, 5*a*, 5*b*. Accordingly, it is possible to suppress the presence of light (diffused light) traveling on the optical path that exerts ill effects on the formation of the low-beam distribution pattern.

As a result, the reduction in this unwanted diffusion light which is incapable of contributing to proper formation of the low-beam distribution pattern results in a light distribution pattern capable of providing bright and excellent visibility with high utilization of light. It is also possible to reduce dazzling or glaring light directed at oncoming traffic, which is an obstacle for drivers of on-coming vehicles. Therefore, the configuration of the mount structure 1 can contribute to safe driving of vehicles.

Figure 4:
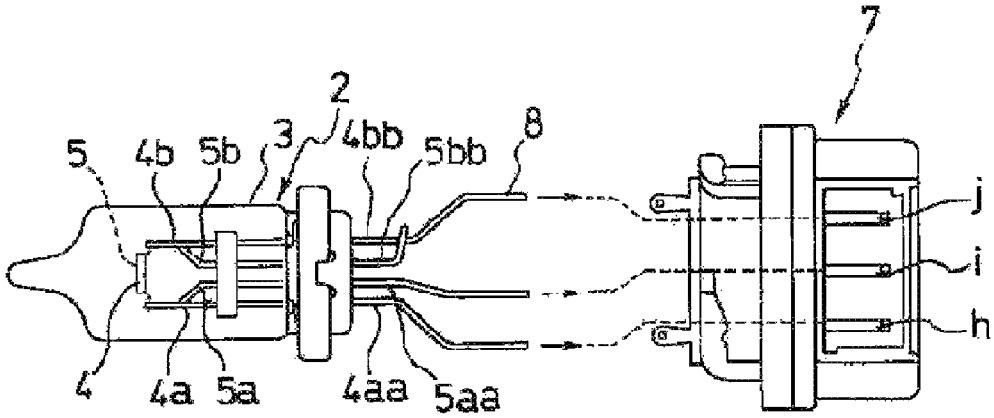
FIG. 4 is an illustrative view of an embodiment of a lamp attached to a bulb base made in accordance with principles of the disclosed subject matter.
Figure 5:
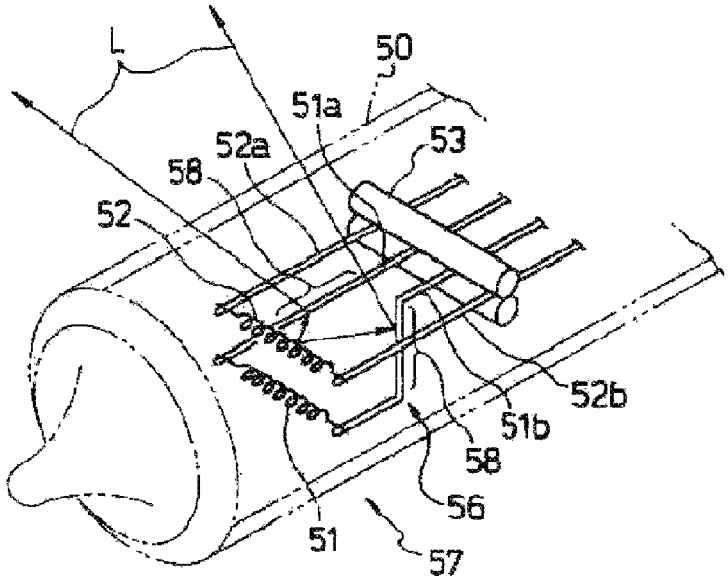
FIG. 5 Conventional Art
FIG. 5 is a perspective view of an example of a conventional art lamp.
Figure 6:
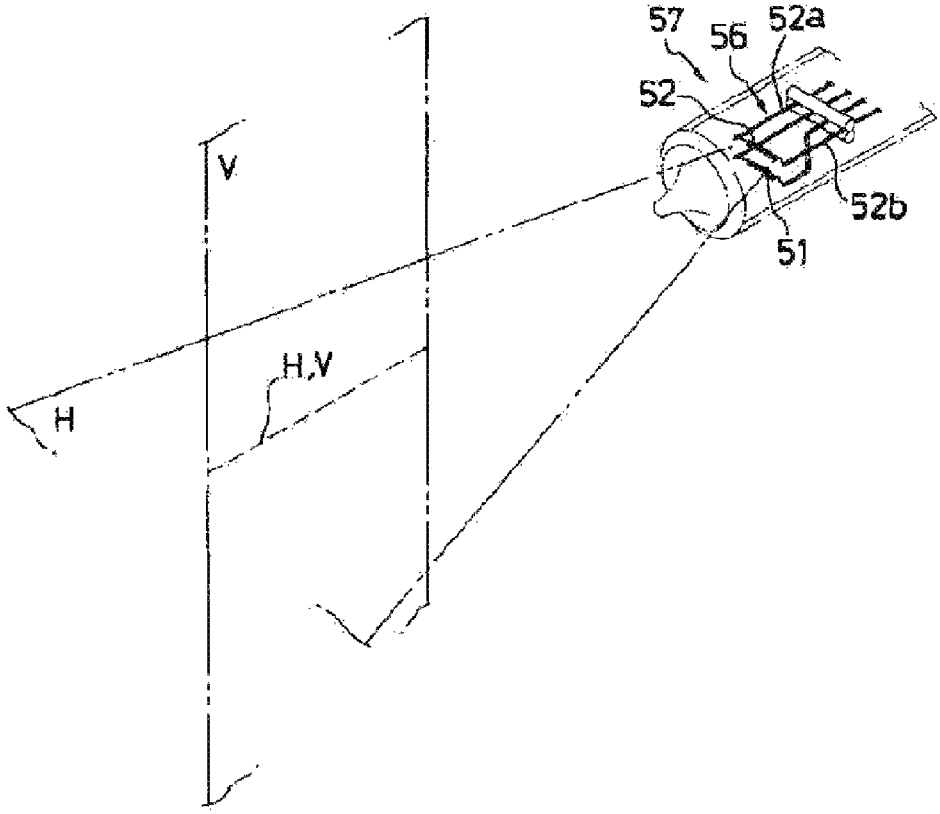
FIG. 6 Conventional Art
FIG. 6 is an illustrative view of the conventional art lamp of FIG. 5.
Figure 7:
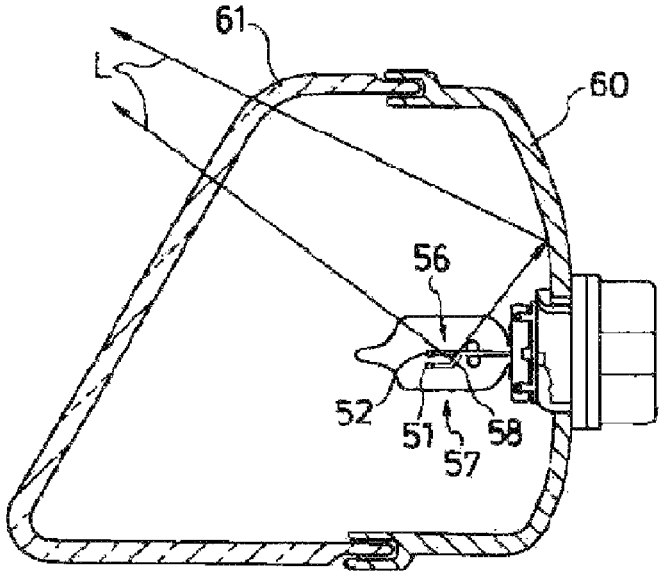
FIG. 7 Conventional Art
FIG. 7 is a cross sectional view of a conventional base-attached lamp covered with a lens and housing.
Figure 8:
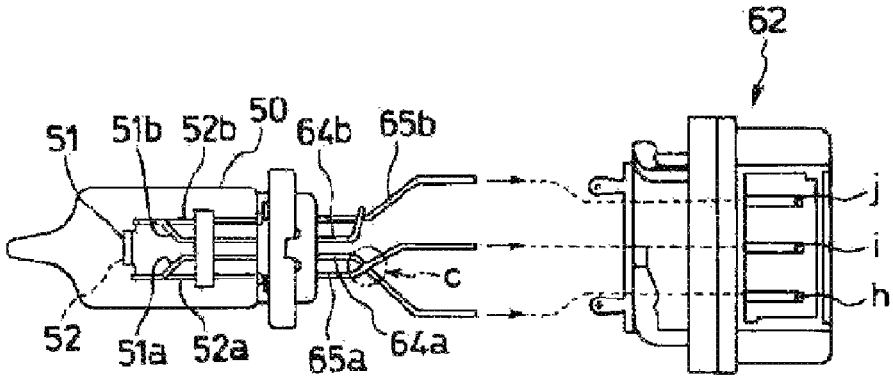
FIG. 8 Conventional Art
FIG. 8 is an illustrative view of a conventional lamp attached to a bulb base.

An electric bulb 2 having the above-configured mount structure 1 can be completed after being fixed to and held on a bulb base. As shown in FIG. 4 (an illustrative view of an electric bulb attached to a bulb base), the bulb base 7 has a common earth terminal (j), a low-beam filament terminal (i), and a high-beam filament terminal (h) arranged in turn from one side.

On the other hand, in the electric bulb 2, the pair of inner leads 4*a*, 4*b* which are electrically connected to the high-beam filament 4 can be configured to lead out straight from the glass bulb 3 to form outer leads 4*aa*, 4*bb*. In addition, the pair of inner leads 5*a*, 5*b* which are electrically connected to the low-beam filament 5 can be configured to lead out straight from the glass bulb 3 to form outer leads 5*aa*, 5*bb*. The outer lead 4*bb* is connected with the outer lead 5*bb* to form a single common earth outer lead 8. The common earth outer lead 8, the outer lead 5*aa* for the low-beam filament, and the outer lead 4*aa* for the high-beam filament are arrayed in turn from one side of the bulb 2.

The common earth terminal (j) on the bulb base is configured for connecting to the common earth outer lead 8 of the electric bulb. Similarly, the low-beam filament terminal (i) on the bulb base 7 is configured for connecting to the outer lead 5*aa* for the low-beam filament, and the high-beam filament terminal (h) on the bulb base 7 is configured for connecting to the outer lead 4*aa* for the high-beam filament. Even in this case, it is possible to prevent outer leads from intersecting with each other and to avoid an occurrence of an electrical short-circuit.

While there has been described what are at present considered to be exemplary embodiments of the invention, it will be understood that various modifications may be made thereto, and it is intended that the appended claims cover such modifications as fall within the true spirit and scope of the invention. All conventional art references described above are herein incorporated in their entirety by reference.

What is claimed is:

1. An electric bulb for use in a vehicular headlamp, comprising:

a low-beam filament and a high-beam filament contained in a substantially cylindrical bulb, the low beam filament extending between a first low beam filament end and a second low beam filament end, and the high beam filament extending between a first high beam filament end and a second high beam filament end;

a pair of first leads for the low-beam filament each having a side end and an opposite end, and the first low beam filament end and the second low beam filament end of the low-beam filament are connected and supported on the side end of the pair of first leads;

a pair of secondary leads for the high-beam filament each having a secondary side end and a secondary opposite end, and the first high beam filament end and the second high beam filament end of the high-beam filament are connected and supported on a respective secondary side end of the pair of secondary leads; and a lead holder in which the opposite ends of the first leads and the secondary opposite ends of the secondary leads are held in line, wherein the low-beam filament is located in a first plane containing an optical axis located substantially on a same line as a longitudinal/central axis of the cylindrical bulb, and the low-beam filament extends in a direction substantially normal to the optical axis, wherein the high-beam filament is located in a second plane parallel with the first plane and the high beam filament extends substantially parallel with the low-beam filament, wherein the pair of first leads are located at positions sandwiched between the pair of secondary leads and are located substantially in the first plane and between the low-beam filament and the lead holder, wherein one of the pair of secondary leads is located in a third plane defined in parallel with the optical axis and substantially normal to the first plane, between the high-beam filament and the lead holder, another one of the pair of secondary leads is located in a fourth plane defined in parallel with the optical axis and substantially normal to the first plane, between the high-beam filament and the lead holder, wherein the pair of secondary leads are bent such that an entire area is surrounded by the low-beam filament, the high-beam filament, a first straight line from an inside edge of a right one of the side ends of the first leads to an inside edge of a right one of the secondary side ends of the second leads and a second straight line from an inside edge of a left one of the side ends of the first leads to an inside edge of a left one of the secondary side ends of the second leads, and contains neither a portion of the pair of first leads nor a portion of the pair of secondary leads in a view from a side of the low-beam filament and the high-beam filament toward the lead holder.

2. The electric bulb according to claim 1, wherein the pair of first leads includes at least two bent parts formed between the low-beam filament and the lead holder, and the pair of secondary leads includes at least two bent parts formed between the high-beam filament and the lead holder.

3. The electric bulb according to claim 2, wherein the pair of first leads and the pair of secondary leads include a pair of leads located adjacent to each other at the lead holder and connected together to form a common earth lead, the electric bulb further comprising, a bulb base having a common earth terminal, a low-beam filament terminal, and a high-beam filament terminal, wherein the common earth terminal is connected to the common earth lead, the low-beam filament terminal is connected to at least one of the pair of first leads, and the high-beam filament terminal is connected to at least one of the pair of secondary leads.

4. The electric bulb according to claim 3, wherein the bulb encloses at least one of a halogen gas and a halogen compound gas.

5. The electric bulb according to claim 2, wherein the bulb encloses at least one of a halogen gas and a halogen compound gas.

6. The electric bulb according to claim 1, wherein the bulb encloses at least one of a halogen gas and a halogen compound gas.

7. The electric bulb according to claim 1, wherein the pair of first leads and the pair of secondary leads include a pair of leads located adjacent to each other at the lead holder and connected together to form a common earth lead, the electric bulb further comprising, a bulb base having a common earth terminal, a low-beam filament terminal, and a high-beam filament terminal, wherein the common earth terminal is connected to the common earth lead, the low-beam filament terminal is connected to at least one of the pair of first leads, and the high-beam filament terminal is connected to at least one of the pair of secondary leads.

8. The electric bulb according to claim 1, wherein the bulb is a glass bulb.

9. The electric bulb according to claim 1, wherein the lead holder includes a first portion located above the pair of first leads and a second portion located below the first leads such that the first leads are sandwiched between the first portion and the second portion of the lead holder.

10. An electric bulb for use in a vehicular headlamp, comprising:

a low-beam filament and a high-beam filament contained in a bulb;

a pair of first leads for the low-beam filament each having a side end connected to the low-beam filament;

a pair of secondary leads for the high-beam filament each having a secondary side end connected to the high-beam filament; and a lead holder in which the first leads and the secondary leads are held in line, wherein the low-beam filament is located in a first plane containing an optical axis located substantially on a same line as a longitudinal/central axis of the bulb, and the low-beam filament extending in a direction substantially normal to the optical axis, wherein the high-beam filament is located in a second plane parallel with the first plane and the high beam filament extends substantially parallel with the low-beam filament, wherein the pair of first leads are located at positions sandwiched between the pair of secondary leads at the juncture of the lead holder and the first and secondary leads, and the first leads are substantially entirely located in the first plane and between the low-beam filament and the lead holder, wherein at least a portion of one of the pair of secondary leads is substantially entirely located in a third plane that is substantially parallel with the optical axis and substantially normal to the first plane, and the portion of the one of the pair of secondary leads extends the entire distance between the high-beam filament and the lead holder, a portion of another one of the pair of secondary leads is located in a fourth plane that is substantially parallel with the optical axis and substantially normal to the first plane, and the portion of the another one of the pair of secondary leads extends the entire distance between the high-beam filament and the lead holder, wherein the pair of secondary leads are bent such that an entire area is surrounded by the low-beam filament, the high-beam filament, a first straight line from an inside edge of a right one of the side ends of the first leads to an inside edge of a right one of the secondary side ends of the secondary leads and a second straight line from an inside edge of a left one of the side ends of the first leads to an inside edge of a left one of the secondary side ends of the secondary leads, and contains neither a portion of the pair of the first leads nor a portion of the pair of secondary leads in a view from a side of the low-beam filament and the high-beam filament toward the lead holder.

11. The electric bulb according to claim 10, wherein the pair of first leads includes at least two bent parts formed between the low-beam filament and the lead holder, and the pair of secondary leads includes at least two bent parts formed between the high-beam filament and the lead holder.

12. The electric bulb according to claim 11, wherein the pair of first leads and the pair of secondary leads include a pair of leads located adjacent to each other at the lead holder and connected together to form a common earth lead, the electric bulb further comprising, a bulb base having a common earth terminal, a low-beam filament terminal, and a high-beam filament terminal, wherein the common earth terminal is connected to the common earth lead, the low-beam filament terminal is connected to at least one of the pair of first leads, and the high-beam filament terminal is connected to at least one of the pair of secondary leads.

13. The electric bulb according to claim 12, wherein the bulb encloses at least one of a halogen gas and a halogen compound gas.

14. The electric bulb according to claim 10, wherein at least a portion of another one of the pair of secondary leads is substantially entirely located in a fourth plane that is substantially parallel with the optical axis and the third plane, and substantially normal to the first plane, and the portion of the another one of the pair of secondary leads extends the entire distance between the high-beam filament and the lead holder.

15. The electric bulb according to claim 10, wherein each of the first leads is substantially S-shaped and portions of the first leads that extend an entire distance between the low-beam filament and the lead holder are entirely located in the first plane, and each of the secondary leads is substantially S-shaped and located in a plane that is substantially normal to the first plane and substantially parallel with the optical axis such that a first of the secondary leads is located on a first side of the optical axis and in a primary plane and a second of the secondary leads is located on a second side of the optical axis and in a secondary plane that is parallel with the primary plane.

* * * * *